US008616032B2

(12) United States Patent
Holowin et al.

(10) Patent No.: US 8,616,032 B2
(45) Date of Patent: Dec. 31, 2013

(54) COMBINED MECHANICAL AND ELECTRONIC KEY

(75) Inventors: Stefan Holowin, Essen (DE); Miroslaw Koziol, Wuppertal (DE)

(73) Assignee: Huf Hulsbeck & Furst GmbH & Co., KG (DE)

( * ) Notice: Subject to any disclaimer, the term of this patent is extended or adjusted under 35 U.S.C. 154(b) by 0 days.

(21) Appl. No.: 13/326,702

(22) Filed: Dec. 15, 2011

(65) Prior Publication Data

US 2012/0151977 A1 Jun. 21, 2012

(30) Foreign Application Priority Data

Dec. 17, 2010 (DE) ..... 10 2010 061 331

(51) Int. Cl.
*A44B 15/00* (2006.01)

(52) U.S. Cl.
USPC ..... 70/456 R; 70/408

(58) Field of Classification Search
USPC ..... 70/408, 456 R
See application file for complete search history.

(56) References Cited

U.S. PATENT DOCUMENTS 2,822,684 A * 2/1958 Ray ..... 70/456 R
4,660,397 A * 4/1987 Girimont ..... 70/456 R
4,888,970 A * 12/1989 Kinzler et al. ..... 70/456 R
5,495,942 A * 3/1996 Izhak ..... 206/372
5,943,889 A * 8/1999 Chiu ..... 70/456 R
6,499,326 B1 * 12/2002 Heussner ..... 70/399
6,705,141 B1 * 3/2004 Jacob et al. ..... 70/408
6,892,558 B2 * 5/2005 Chodosh ..... 70/456 R
7,055,352 B2 * 6/2006 Meyerson et al. ..... 70/456 R
7,370,501 B2 * 5/2008 Miyata et al. ..... 70/395
8,225,633 B2 * 7/2012 Luo et al. ..... 70/456 R
8,266,936 B2 * 9/2012 Box et al. ..... 70/408

FOREIGN PATENT DOCUMENTS

DE 102006036503 A1 2/2008

* cited by examiner

*Primary Examiner* — Suzanne Barrett
(74) *Attorney, Agent, or Firm* — Cantor Colburn LLP

(57) ABSTRACT

A combined mechanical and electronic key includes a housing with an edge area having a link configured with grooves, electronics disposed in the housing, a key portion, which has a bearing surface mounted in a rotatable manner about an axis along the link, an activating element in the bearing surface having at least two radially projecting wings and a radially projecting driver, where the activating element is movable between a passive and an active position, the key portion is movable between an inoperative position and an operative position, where in the inoperative and operative positions, in which the activating element occupies the passive position, each wing is in a respective groove, and during the movement between the inoperative and operative positions, in which the activating element occupies the active position, the wings are detached from the grooves, and the driver engages with a contour of the bearing surface.

15 Claims, 3 Drawing Sheets

COMBINED MECHANICAL AND ELECTRONIC KEY

TECHNICAL FIELD

The invention relates to a combined mechanical and electronic key that is intended for a motor vehicle and comprises a housing with an edge area that has a link configured with a plurality of grooves, electronics disposed in the housing, a key portion, which has a bearing that is mounted in a rotatable manner about an axis along the link, an activating element, which is accommodated in the bearing surface and has at least two radially projecting wings and a radially projecting driver; and the activating element can be moved between a passive and an active position. The key portion can be moved between an inoperative position and an operative position. In the inoperative position and in the operative position of the key portion, in which the activating element occupies the passive position, each wing is in a respective groove; and during the movement between the inoperative position and the operative position, in which the activating element occupies the active position, the wings are detached from the grooves, and the driver engages with a contour of the bearing surface.

BRIEF DESCRIPTION OF RELATED ART

Such ID transmitters are described, for example, in the DE 10 2006 036 503 A1. The drawback of such devices is that it is often the situation that the extended key portions are used by users for other—improper—functions, in order, for example, to open various containers with the extended key portion. For this reason it is often the case that the material degrades at the bearing surface of the key portion, so that areas of the housing can break off.

BRIEF SUMMARY

The invention seeks to avoid the aforementioned drawbacks. In particular, the invention provides a combined mechanical and electronic key with a housing that can absorb the higher forces that can act on the key portion.

The invention provides that the grooves comprise at least a first pair of grooves and a second pair of grooves. In the inoperative position of the key portion the wings are snapped into place in the first pair of grooves; and in the operative position of the key portion the wings are snapped into place in the second pair of grooves. In this case the link is designed in such a way that the second pair of grooves is aligned relative to the interior of the housing, so that high forces coming from the key portion on the housing can be absorbed. The essential idea of the invention is that in the operative position of the key portion the wings are received in the second pairs of grooves lying within. At the same time the second pairs of grooves have a larger material mass, which the housing makes available to the bearing surface. If at this point the user makes improper use of the key portion, so that higher forces act on the key portion and on the contour of the bearing surface, these higher loads are absorbed in a reliable manner at the bearing surface owing to the second pairs of grooves lying within, so that there can be no degradation of the material at the housing. In addition, it is provided that in the operative position of the key portion the wings are received in the second pairs of grooves lying within. At the same time the second pairs of grooves have a larger material mass that the housing makes available to the bearing surface. If at this point the user makes an improper use of the key portion, so that higher forces act on the key portion and on the contour of the bearing surface, these higher loads are absorbed in a reliable manner at the bearing surface owing to the second pairs of grooves lying within, so that there can be no degradation of the material at the housing.

According to the invention, the activating element is mounted in the bearing surface so as to be axially displaceable relative to the axis of rotation of the key portion. The activating element is advantageously a knob, push button, etc. that is accessible from the outside and that can be actuated by the user, in order to cause the key portion to move between the inoperative and the operative position. Actuating the activating element causes the wings to move out of the locking position of the grooves, so that it is possible for the key portion to move about the axis of rotation.

In a preferred embodiment of the invention it is conceivable that the electronics are sealed off from the exterior of the key by a wall, so that at the same time the wall separates the link from the electronics. The electronics may have, for example, transmitting units and/or receiving units that provide for a data communication between the combined key—also called the ID transmitter—and the motor vehicle, in particular, its locking device and/or central locking device. During the data communication it is possible to substitute, for example, a code, preferably by means of electromagnetic waves, so that after a positive evaluation of the code it is possible, for example, to unlock and/or lock by remote control the doors, the trunk lid of the motor vehicle, etc. and to trigger additional functions. In order to protect the electronics, encapsulated inside the housing, against environmental influences, such as moisture, dirt, particles, etc., the wall provides for suitable protection. It is advantageous for the housing to comprise at least two housing shells that are placed one on top of the other and at the same time encapsulate the electronics and simultaneously ensure that the key portion is suitably held at the bearing surface. It is advantageous for the housing to have at least one key element in order to start a data communication between the ID transmitter and the motor vehicle and to trigger corresponding functions by actuating the key element.

It is expedient for the bearing surface to be positioned at a distance from the wall that encapsulates the electronics. This feature allows the key portion to be moved in a reliable way between its two positions, so that in each position of the key portion it is guaranteed that the electronics are protected against the exterior.

One strategy for improving the invention may provide that the wings point in the direction of the wall when the key portion is in the operative position; and, in particular, the driver is oriented relative to the exterior of the key portion. It is advantageous for the protecting wall to be set apart from the bearing surafce, so that the wall is arranged between the link of the housing and the interior of the housing. At the same time the housing can absorb larger forces coming from the key portion, because when the key portion is in the operative position, the wings are oriented relative to the interior of the housing and, thus, to the protecting wall. In this position of the wings, which are snapped into place inside the second pairs of grooves, the housing offers a large material mass, on which the wings can be supported, without causing any degradation of the material at the housing.

Similarly it is conceivable that the contour of the bearing surface has at least two planes. A first plane has a recess, in which the driver is accommodated during the movement of the key portion between its positions. This feature allows the activating element to perform a stroke inside the bearing surface, in order to move between the passive and the active position. The driver is in the recess of the first plane, when the activating element is in its active position. In the active position the activating element is simultaneously detached with its wings and/or set apart from the link of the housing, so that a corresponding rotational movement of the key portion with its bearing surface about the axis is possible. During the movement of the key portion, the wings also rotate about the axis, thus holding the driver rigidly in the recess of the first plane.

In addition, the contour of the bearing surface can have a second plane that has two recesses, in which the wings are located when the key portion is in the inoperative position and the operative position. In the passive position of the activating element the key portion is either in the inoperative position or in the operative position. The second plane can lie, for example, above or below the first plane inside the bearing surface of the key portion. In the passive position of the activating element each wing is in a recess of the contour of the bearing surface, where it is held in a locking manner and/or in a form fitting manner. At the same time each wing is located inside a groove of the link of the housing. Thus, in this position of the key portion it is impossible for the key portion to move without simultaneously actuating the activating element.

Preferably the activating element performs a linear stroke between its passive and its active position. Then the wings and the driver move between the first and the second plane and take the respective position inside the contour of the bearing surface. It is advantageous for the activating element to have a cylindrical base body with a shell that has the wings and the driver, both of which extend from the shell, in particular, in the form of a star.

It is advantageous to provide that the activating element is spring loaded and, in particular, that the activating element is designed like a sleeve and has a cavity, in which there is a spring element that acts on the activating element. For example, it is possible that the spring element is a spiral spring that exerts a force on the activating element in the direction of the axis when the key portion is in the inoperative position. At the same time the spiral spring exerts a torque on the activating element. If the user actuates the activating element, the activating element performs a lifting movement inside the bearing surface of the key portion. The wings leave the grooves of the link and, in so doing, cancel the locking position. At the same time the driver moves into the recess of the bearing surface of the key portion. As an alternative, in each position of the key portion the driver is in the recess of the bearing surface. In order for the activating element to be able to perform a suitable lifting movement, the user has to exert a larger force on the activating element than the force that the spring element exerts on the activating element in the direction of the axis of rotation of the key portion. If the activating element is outside the locking position relative to the link of the housing—that means, the wings of the activating element are detached from each groove of the link—the torque, which the spring element exerts on the activating element, causes the key portion to move out of its inoperative position into the operative position. The result is a simple "automatic" extension of the key portion into the operative position. In order for the user to be able to move the key portion back into the inoperative position, the activating element has to be re-actuated; and at the same time a manual force has to be applied to the key portion; and this manual force moves the key portion into the inoperative position. In the course of moving the key portion from the operative position into the inoperative position, the spring element exerts in an advantageous way a corresponding force on the activating element in the direction of the axis of rotation. The shoulder-like wings slide down the sliding surfaces, which can be found between the pairs of grooves of the link, until the wings reach the grooves or have arrived above the grooves, so that the compressive force of the spring pushes the activating element with its wings into the grooves, with the result that the snap lock connection is produced again.

Preferably the bearing surface can have a guide cam that moves in a recess that extends about the axis of rotation of the key portion. This guide cam can have the function inside the whole construction that a reliable rotational movement of the key portion about its axis of rotation is guaranteed. The recess, which extends about the axis of rotation of the key portion and in which the guide cam moves along while the key portion is moving, is arranged in the housing so as to be positioned at a distance from the link. The recess can have a first and/or a second stop, against which the guide cam of the bearing surface can move. In this way the inoperative position and/or the operative position of the key portion can be defined. The wings of the activating element can have different lengths and different widths. This geometric design of the wings has the effect that when the key portion is in the operative position, a large engagement surface is created between the wings and the link, in particular, the second pair of grooves, so that the link of the housing can absorb larger forces that may be introduced by way of the extended key portion into the ID transmitter or rather into the combined key.

In one possible embodiment of the invention the angle of rotation $\alpha$ [alpha] between the inoperative position and the operative position can be $\alpha=180°$. This means that the key can be swiveled by an angle, which amounts to $\alpha=180°$, about its axis of rotation of the bearing surface from its retracted position (inoperative position) to its extended position (operative position). For this embodiment of the invention the first pair of grooves and the second pair of grooves are arranged symmetrically inside the link of the housing. A swivel range, in which the angle $\alpha$ [alpha] is less than or greater than 180°, is also conceivable. For this variants of the embodiment it is only necessary that the position of the first pair of grooves and the second pair of grooves be chosen correspondingly inside the link, in order to guarantee a reliable locking position of the key portion in the inoperative position and also in the operative position.

In one advantageous embodiment the housing can comprise two housing shells and/or housing halves with a sealing element. In particular, the housing with the sealing element can be a two components injection molded part. As an alternative, the sealing element can be attached to one of the housing shells and/or the protecting wall in a form and/or force fitting way and/or by material bonding. The housing and/or the link with its sliding surfaces can be made of a glass fiber reinforced polyamide. In addition, the material of the housing and/or the link can have glass fibers and/or carbon fibers and/or aramide fibers. In an additional embodiment of the invention the key portion and the bearing surface can be made of a metal material; and in one advantageous embodiment of the invention the bearing surface and the key portion form a joint component—in particular, a monolithic component.

Even the contour of the bearing surface with the two recesses for the wings and the recess for the driver can form a joint component with the key portion. As an alternative and/or in addition, it can be provided that the housing and/or a housing half form (forms) a component of uniform material—in particular, a synthetic plastic material—with the link and/or the wall including the pairs of grooves.

BRIEF DESCRIPTION OF THE DRAWINGS

Additional advantages, features and details of the invention are apparent from the following description, in which one possible exemplary embodiment of the invention is described in detail with reference to the drawings. At the same time the features disclosed in the claims and in the description may be essential for the invention individually or in any combination.

DETAILED DESCRIPTION

Figure 1:
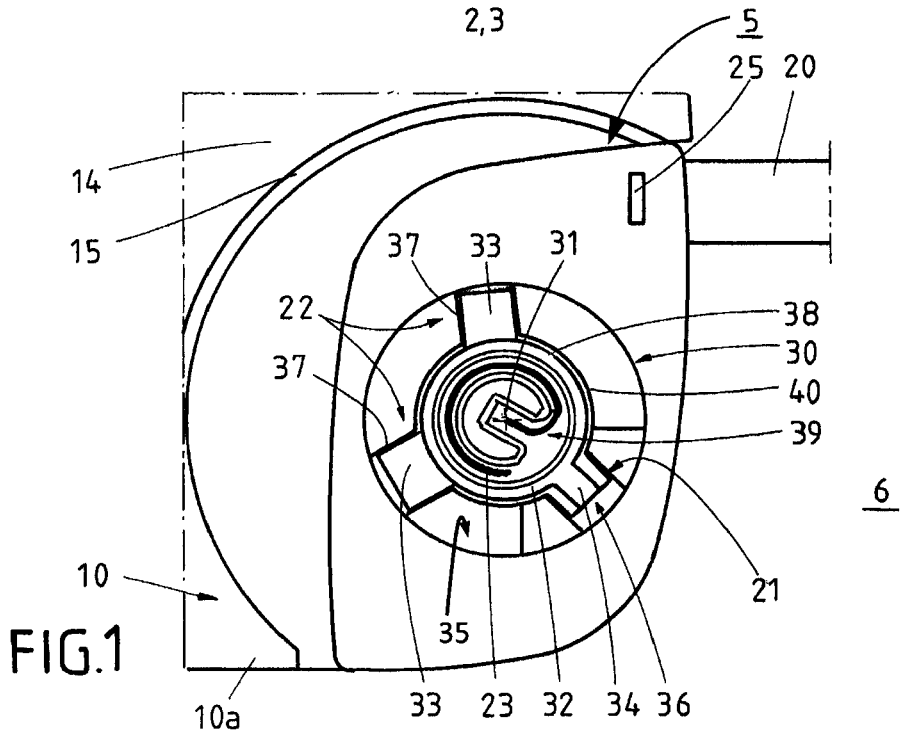
FIG. 1 is a highly simplified schematic view of the combined key, where the key portion s in the operative position.

FIGS. 1 to 5 show in each case an exemplary embodiment of a combined mechanical and electronic key 1 (hereinafter referred to as the combined key), which has a key portion 20 that can be moved between an inoperative position 4 and an operative position 5. The combined key 1, which can also be called the ID transmitter, comprises a housing 10 with an edge region 11 that has a link 13. The link 13 comprises a plurality of grooves 12 that lie in a plane. In the present exemplary embodiment there are four grooves 12, between which sliding surfaces 24 extend.

In addition, the housing 10, which can comprise, for example, two housing shells or rather housing halves 10*a*, 10*b*, which lie one on top of the other, has electronics that are not explicitly shown. The electronics serve to produce the data communications between the motor vehicle 7 and the key 1. The electronics are sealed inside the housing 10 and, thus, reliably encapsulated, so that moisture, dirt, particles, etc. cannot penetrate into the area of the electronics from the exterior 6.

In order for the key portion 20 to be able to move reliably between its positions 4, 5, the key portion 20 has a suitable bearing surface 30, which can be moved about an axis 31 above the link 13 of the housing 10. As shown in FIG. 1, the bearing surface 30 has a contour 35 that consists of two planes 21, 22. The first plane 21 has a recess 36; and the second plane 22, which lies below the first plane 21, has two recesses 37. In addition, the contour 35 of the bearing surface 30 has a central opening, into which the activating element 32 is inserted. This activating element 32 is mounted below the central opening so that it can be axially displaced relative to the axis of rotation 31 of the key portion 20. This means that the activating element 32 can perform a lifting movement inside the bearing surface 30 in the direction of the drawing plane. This lifting movement will be discussed in more detail below.

Figure 6:
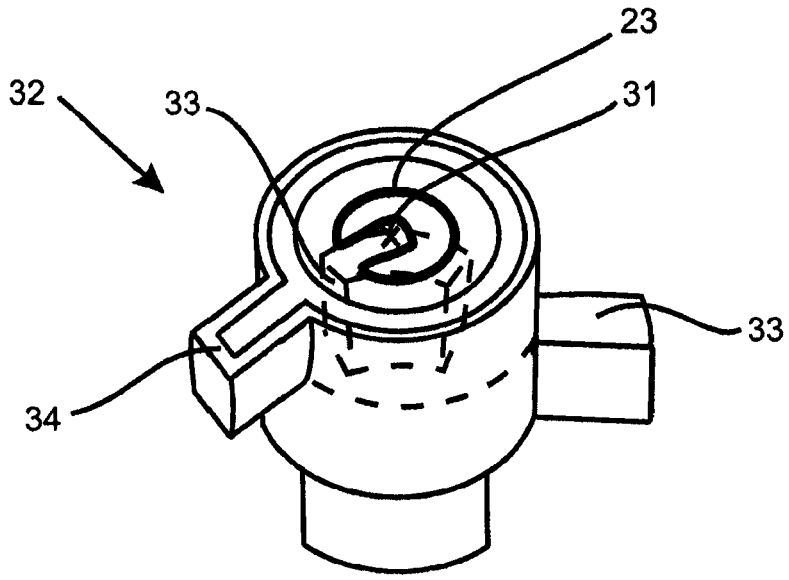
FIG. 6 is a perspective view of an activating element illustrating disposed in the interior in phantom.
Figure 7:
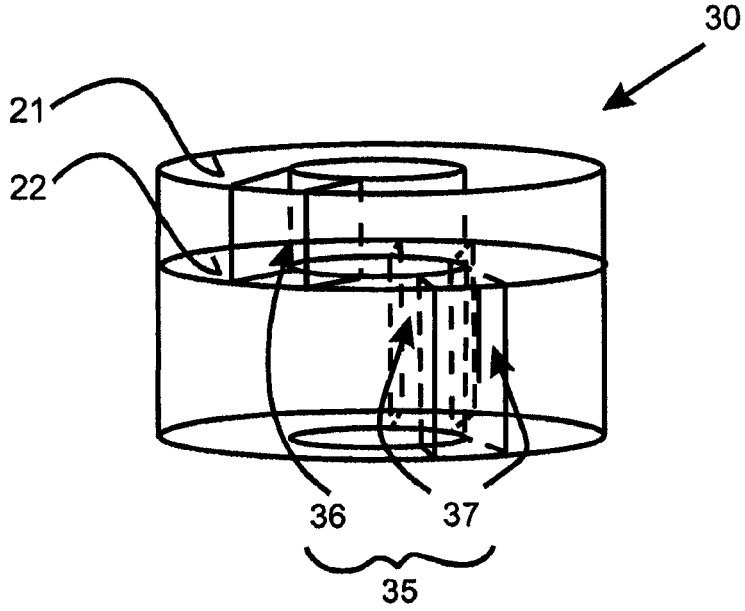
FIG. 7 is a side view of the activating element of FIG. 6.

Thus, the activating element 32 is accommodated in a moveable manner in the bearing point 30 and has two radially projecting wings 33 in the present exemplary embodiment. According to FIG. 1 and FIG. 2, these wings are in the recesses 37 of the bearing point 30. Furthermore, the activating element 32 has a radially projecting driver 34, which is positioned, according to FIG. 1 and FIG. 2, below the recess 36 and, thus, is not inside the recess 36 of the bearing point 30, as illustrated in FIGS. 6 and 7.

Figure 2:
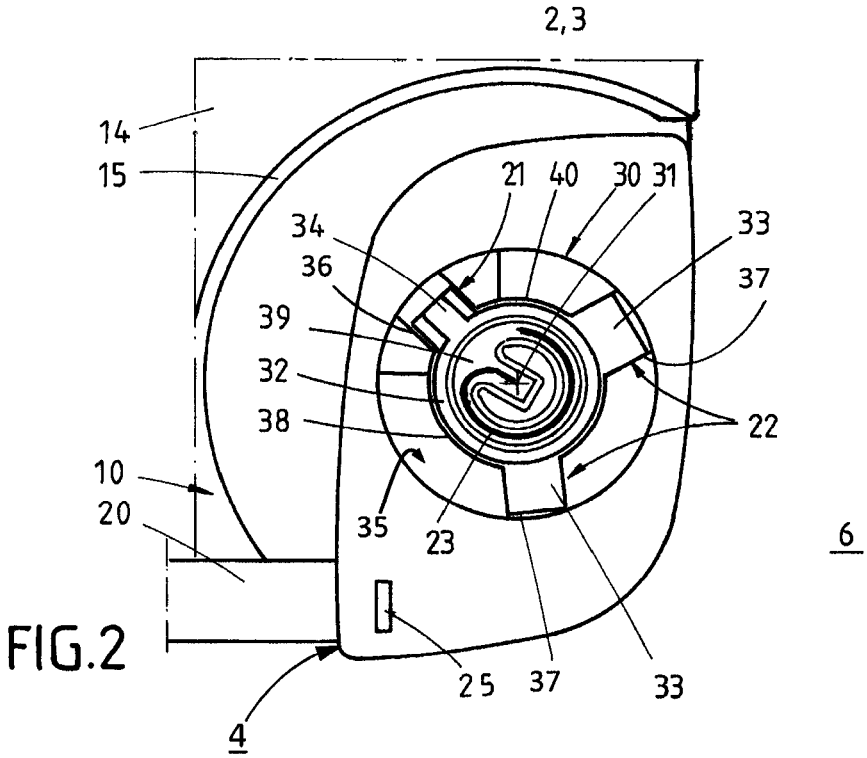
FIG. 2 shows the combined key according to FIG. 1, where the key portion is in the inoperative position.
Figure 3:
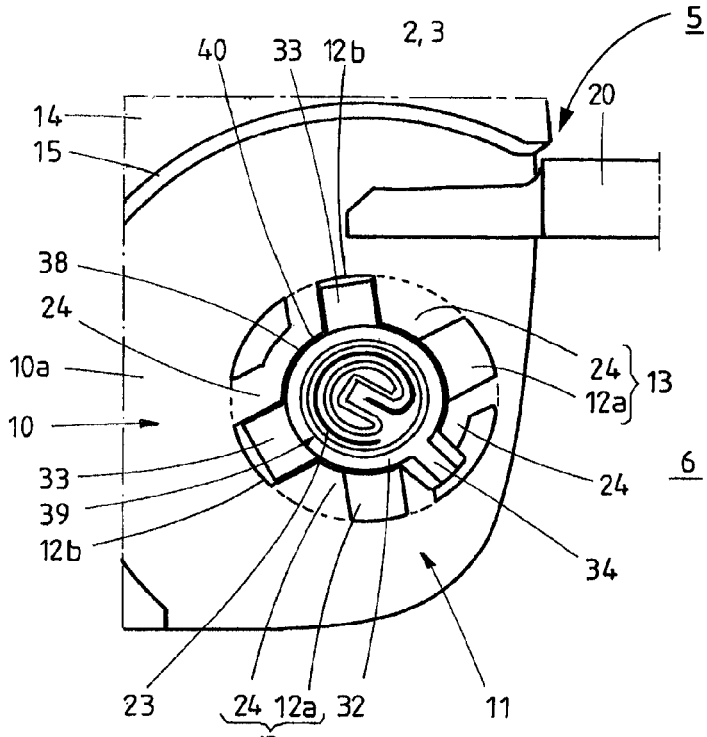
FIG. 3 is another simplified view of the combined key according to FIG. 1.
Figure 4:
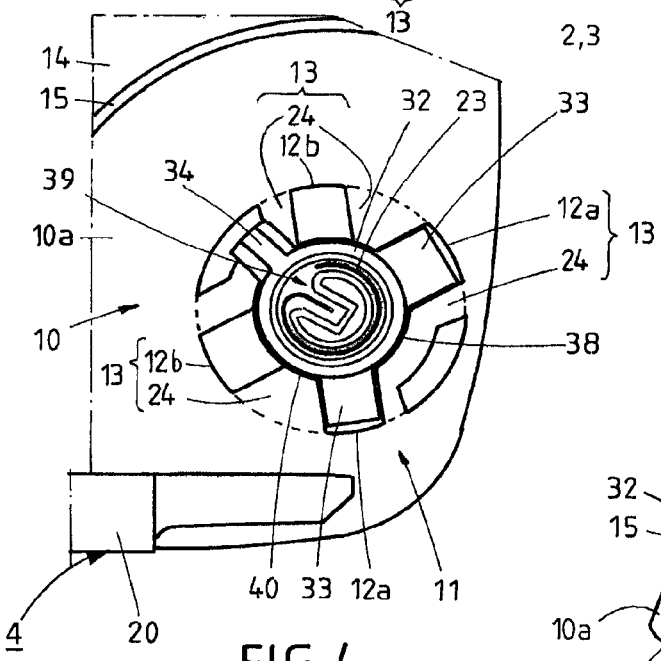
FIG. 4 is another simplified view of the combined key according to FIG. 2.
Figure 5:
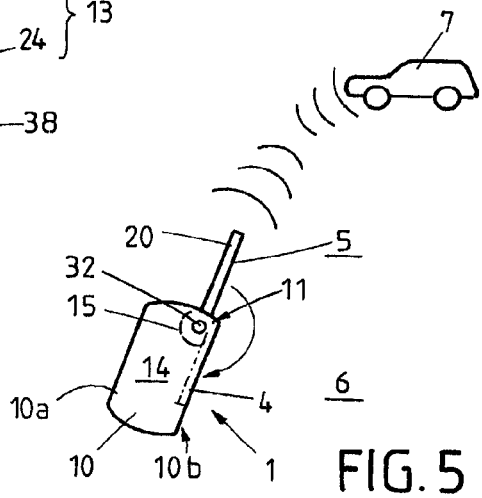
FIG. 5 is a simplified view of the combined key with the associated motor vehicle.

According to FIG. 3 and FIG. 4, both wings 33 engage simultaneously with the grooves 12 of the link 13 as a function of the position 4, 5 of the key portion 20. FIG. 3 shows the operative position 5 of the key portion 20. According to the exemplary embodiment, the grooves 12 comprise a first pair of grooves 12*a* and a second pair of grooves 12*b*. The pairs of grooves 12*a*, 12*b* lie below the bearing surface 30, according to FIG. 1 and FIG. 2. In the operative position 5 of the key portion 20 the wings 33 are snapped into place in the second pair of grooves 12*b*, so that a movement of the key portion 20 in the direction of the inoperative position 4, according to FIG. 2 and FIG. 4, is blocked. Since the second pair of grooves 12*b* is oriented relative to the interior 14 of the housing 10, high forces coming from the key portion 20 on the housing 10, in particular, in the grooves 12 can be absorbed. If, for example, the position of the second pair of grooves 12*b* were rotated by 180° about the axis 31, then less housing material would be available to absorb any forces coming from the key portion 20 with the deleterious consequence that in such a case it could lead to faster degradation of the material in the area of the link 13.

It is clearly evident from all of the figures that the housing 10 has a wall 15 that seals the electronics, which are not explicitly shown herein, from the exterior 6 of the key 1. At the same time the wall 15 separates the link 13 from the electronics. When the key portion 20 is in the operative position 5, the wings 33 are in the second pair of grooves 12*b* and point towards the wall 15, so that the driver 34 of the activating element 32 is oriented relative to the exterior 6 of the key 1. The driver 34 is on the sliding surface 24.

The activating element 32 also has different planes. The two wings 33 are in the bottom plane; and the driver 34 is positioned in the upper plane. According to FIG. 3, the driver 34 is above the wings 33 that are accommodated so as to snap lock into place in the second pair of grooves 12*b*.

According to FIG. 4, both wings 33 are in the first pair of grooves 12*a* that is in alignment with the exterior 6. At the same time the driver 34 lies on the sliding surface 24 that lies between the second pair of grooves 12*b*.

According to the exemplary embodiment that is shown, the activating element 32 has a cylindrical base body 38 with a shell 40 that has the wings 33 and the driver 34. The wings 33 and the driver 34 extend outwards from the shell 40 in the form of a star. A spring element 23, which is depicted only as a schematic in the drawing, acts on the activating element 32. The spring element 23 may be, for example, a spiral spring. The activating element 32 has a sleeve-like shape with a cavity 39, in which the spring element 23 is arranged and acts on the activating element 32. On the one hand, the spring element 23 acts with a force in the direction of the axis 31 on the activating element 32, when the key portion 20 is in the inoperative position 4 or in the operative position 5. At the same time the spring element 23 exerts a torque on the activating element 32, when the key portion 20 is in the operative position 5 and/or in the inoperative position 4.

The activating element 32 serves as a type of push button, which is actuated by the user, when it is desired that the key portion 20 move about the axis 31 out of the inoperative position 4 into the operative position 5. When the activating element 32 is suitably actuated in the direction of the axis 31, both wings 33 are lifted out of the first pair of grooves 12*a*, so that at the same time the driver 34 moves into the recess 36 of the bearing surface 30. During this lifting movement of the activating element 32, the wings 33 move inside the recesses 37 of the bearing surface 30. When the activating element 32 is actuated by the user, the actuating element is moved out of its passive position 2, in which the wings 33 are inside the grooves 12, into the active position 3, in which the driver 34 is in the recess 36 of the bearing surface 30. When the wings 33 have left the first pair of grooves 12*a*, the torque, which acts from the spring element 23 and acts on the activating element 32, causes the activating element 32 to be pivoted counterclockwise about the axis 31. At the same time the key portion 20 rotates out of its inoperative position 4, according to FIG. 4, into its operative position 5, which is shown in FIG. 3. While the key portion 20 is moving, the wings 33 slide down along the sliding surfaces 24 of the contour 35. If the wings 33 lie above the second pair of grooves 12*b*, the spring force, acting from the spring element 23 and acting in the direction of the axis 31, causes the activating element 32 to move back into the passive position 2 by way of a lifting movement. At the same time the spring element 23 pushes the wings 33 in the drawing plane into the second pair of grooves 12*b*, as a result of which a locking connection of the bearing surface 30 in the link 13 is produced. During this movement of the activating element 32 back into the passive position 2, the driver 34 simultaneously leaves the recess 36 of the bearing surface 30. In this way the operative position 5, according to FIG. 1 and FIG. 3, is reached. In an alternative of the invention, the recess 36 and/or the driver 34 is designed in such a way that in each position 2, 3 of the activating element 32, the driver 34 is in the recess 36.

When at this point the user would like to move the key portion 20 out of the operative position 5 into the inoperative position 4, the activating element 32 must be reactuated again. Then the activating element 32 leaves via a lifting movement its passive position 2 in the direction of the active position 3, in the course of which the wings 33 leave the second pair of grooves 12*b*; and at the same time the driver 34 moves into the recess 36 of the bearing surface 30. Since the spring element 23 exerts, according to FIG. 3, a torque on the activating element 32 in the counterclockwise direction, it is necessary for the user to exert a corresponding force (larger than the opposing torque) on the key portion 20, so that it is swiveled about the axis 31 from the operative position 5 in the direction of the inoperative position 4. At the same time the wings 33 move on the sliding surfaces 24, until the wings 33 are above the first pair of grooves 12*a*. The spring force, acting on the activating element 32 in the direction of the axis 31, makes sure that the activating element 32 is pressed in a snap locking manner into the first pair of grooves 12*a* with the wings 33.

In the exemplary embodiment that is depicted, the angle of rotation $\alpha$ [alpha] between the inoperative position 4 and the operative position 5 is $\alpha=180°$. FIG. 1 and FIG. 2 show in each case a schematic of a guide cam 25, which moves in a recess (not explicitly shown) that extends about the axis of rotation 31 of the key portion 20 and that is located in the housing 10. The guide cam 25 allows the key portion 20 to perform a satisfactory rotational movement about the axis 31. At the same time the guide cam 25 can move against a first and/or a second stop in the recess that is not explicitly shown, so that the operative position 5 and the inoperative position 4 of the key portion 20 are defined.

The wings 33 can have a different width B and/or different length L relative to each other, so that the result is a larger engagement surface between the wings 33 and the second pair of grooves 12*b*. This feature allows the link 13 and the housing 10 to absorb larger forces coming from the key portion 20.

The invention claimed is:

1. Combined mechanical and electronic key that is intended for a motor vehicle, comprising:

a housing with an edge area having a supporting link, the supporting link configured with a plurality of grooves of the housing that are depressed in the supporting link to form sliding surfaces raised above the groves therebetween, electronics disposed in the housing, a key portion, which has a bearing surface that is mounted in a rotatable manner about an axis along the link, and an activating element, which is accommodated in the bearing surface and has at least two radially projecting wings and a radially projecting driver;

wherein the activating element can be moved between a passive and an active position;

wherein the key portion can be moved between an inoperative position and an operative position;

wherein in the inoperative position and in the operative position of the key portion, in which the activating element occupies the passive position, each wing is in a respective groove of the housing; and wherein during movement between the inoperative position and the operative position, in which the activating element occupies the active position, the wings are detached from the grooves of the housing, and the driver engages with a contour of the bearing surface, wherein the grooves of the housing comprise at least a first pair of grooves and a second pair of grooves; and wherein in the inoperative position of the key portion the wings are snapped into place in the first pair of grooves of the housing; and in the operative position of the key portion the wings are snapped into place in the second pair of grooves of the housing; and the link is designed in such a way that the second pair of grooves of the housing is aligned relative to the interior of the housing, so that high forces coming from the key portion on the housing can be absorbed.

2. Combined key, as claimed in claim 1, wherein the activating element is mounted in the bearing surface so as to be axially displaceable relative to the axis of rotation of the key portion.

3. Combined key, as claimed in claim 1, wherein the electronics are sealed off from an exterior of the key by a wall, so that the wall simultaneously separates the link from the electronics.

4. Combined key, as claimed in claim 3, wherein the wings point in a direction of the wall when the key portion is in the operative position; and the driver is oriented relative to the exterior of the key portion.

5. Combined key, as claimed in claim 1, wherein the contour of the bearing surface has at least two planes, and a first plane has a recess, in which the driver is accommodated during the movement of the key portion between its positions.

6. Combined key, as claimed in claim 5, wherein the contour has a second plane that has two recesses, in which the wings are located when the key portion is in the inoperative position and the operative position.

7. Combined key, as claimed in claim 1, wherein the activating element has a cylindrical base body with a shell that has the wings and the driver, both of which extend from the shell in the form of a star.

8. Combined key, as claimed in claim 1, wherein the activating element is spring loaded and wherein the activating element is designed in a manner of a sleeve and has a cavity, in which there is a spring element that acts on the activating element.

9. Combined key, as claimed in claim 1, wherein the spring element is a spiral spring that exerts a force on the activating element in a direction of the axis when the key portion is in the inoperative position; and at the same time the spiral spring exerts a torque on the actuating element.

10. Combined key, as claimed in claim 1, wherein the link has sliding surfaces between the pairs of grooves, and these sliding surfaces make contact with the wings during movement of the key portion between the positions.

11. Combined key, as claimed in claim 1, wherein the bearing surface has a guide cam that moves in a recess that extends about the axis of rotation of the key portion.

12. Combined key, as claimed in claim 1, wherein the wings are designed differently in their width.

13. Combined key, as claimed in claim 1, wherein an angle of rotation $\alpha$ between the inoperative position and the operative position is $\alpha=180°$.

14. Combined key, as claimed in claim 1, wherein the wings lie at the activating element in a plane that is different from a plane in which the driver is arranged on the activating element.

15. Combined key, as claimed in claim 1, wherein the bearing surface is mounted in a moveable manner inside two housing halves, and wherein the housing halves are oriented approximately perpendicular to the axis of rotation of the key portion.

* * * * *